US008925755B2

(12) United States Patent
Lesquir et al.

(10) Patent No.: US 8,925,755 B2
(45) Date of Patent: Jan. 6, 2015

(54) TAMPER EVIDENT SYSTEM AND METHOD

(75) Inventors: Dominique Lesquir, Alpes Maritimes (FR); Stephane Mercier, Saint-Damien (CA); Steve Lavoie, Pintendre (CA)

(73) Assignee: IPL, Inc., St-Damien, Quebec (CA)

( * ) Notice: Subject to any disclaimer, the term of this patent is extended or adjusted under 35 U.S.C. 154(b) by 150 days.

(21) Appl. No.: 13/635,239

(22) PCT Filed: Apr. 5, 2011

(86) PCT No.: PCT/CA2011/050184
§ 371 (c)(1),
(2), (4) Date: Sep. 14, 2012

(87) PCT Pub. No.: WO2011/127597
PCT Pub. Date: Oct. 20, 2011

(65) Prior Publication Data

US 2013/0020323 A1 Jan. 24, 2013

Related U.S. Application Data

(60) Provisional application No. 61/323,491, filed on Apr. 13, 2010.

(51) Int. Cl.
*B65D 43/02* (2006.01)

(52) U.S. Cl.
CPC .. *B65D 43/0249* (2013.01); *B65D 2543/00027* (2013.01); *B65D 2543/00101* (2013.01); *B65D 2543/00296* (2013.01); *B65D 2543/00509* (2013.01); *B65D 2543/00537* (2013.01); *B65D 2543/00555* (2013.01); *B65D 2543/00629* (2013.01); *B65D 2543/00685* (2013.01); *B65D 2543/0074* (2013.01); *B65D 2543/00796* (2013.01)
USPC ..... 220/266

(58) Field of Classification Search
CPC ..... B65D 2101/003; B65D 2101/0023; B65D 2101/0053; B65D 51/20; B65D 43/0249; B65D 43/0237; B65D 43/0235
USPC ..... 220/266, 265, 276, 260, 324, 315, 4.24, 220/4.23, 4.22, 4.21; 215/256, 254, 253, 215/250
See application file for complete search history.

(56) References Cited

U.S. PATENT DOCUMENTS 4,293,080 A 10/1981 Letica
4,349,119 A 9/1982 Letica
(Continued)

FOREIGN PATENT DOCUMENTS

CA 2056265 5/1992
CA 2114805 3/1995
(Continued)

OTHER PUBLICATIONS

International Search Report of PCT/CA2011/050184 (filed Jul. 14, 2011).

*Primary Examiner* — Robert J Hicks
(74) *Attorney, Agent, or Firm* — Edwards Wildman Palmer LLP; Howard M. Gitten

(57) ABSTRACT

A container comprising a lid comprising a central portion and a circumferential rim, the rim comprising an aperture at least at one location around a perimeter of the rim; and a body comprising a base and lateral walls extending up from the base and ending up in a rim, the rim comprising a knob at least at one location thereof; wherein, in a closed position of the lid over the body, the knob is received in the aperture and is seen emerging from the aperture, and, upon lifting the lid up from the closed position for the first time, the knob disengages from the aperture, thus deforming at least one of the aperture and the rim of the lid, the deformed part testifying of a first opening of the container.

15 Claims, 23 Drawing Sheets

(56) References Cited

U.S. PATENT DOCUMENTS

| | | | |
|---|---|---|---|
| 4,385,711 | A | 5/1983 | Bowen |
| 4,429,805 | A | 2/1984 | Letica |
| 4,446,986 | A | 5/1984 | Bowen et al. |
| 4,711,364 | A | 12/1987 | Letica |
| 4,721,210 | A | 1/1988 | Lawrence et al. |
| 4,742,935 | A | 5/1988 | Schellenberg |
| 4,782,977 | A | 11/1988 | Watanabe et al. |
| 5,033,635 | A | 7/1991 | Philips |
| 5,133,470 | A | 7/1992 | Abrams et al. |
| 5,201,440 | A | 4/1993 | Gross |
| 5,219,087 | A | 6/1993 | Christensson |
| 5,328,046 | A | 7/1994 | Kutz et al. |
| 5,339,973 | A | 8/1994 | Edwards et al. |
| 5,363,979 | A | 11/1994 | Thorso |
| D359,903 | S | 7/1995 | Arshinoff et al. |
| 5,520,301 | A | 5/1996 | Sohn |
| 5,526,954 | A | 6/1996 | Georgiadis |
| 5,617,968 | A | 4/1997 | Luburic |
| 5,626,251 | A | 5/1997 | Luburic et al. |
| 5,758,794 | A | 6/1998 | Rider, Jr. et al. |
| 5,772,330 | A | 6/1998 | Bang et al. |
| 5,785,203 | A | 7/1998 | Arshinoff et al. |
| 5,788,107 | A | 8/1998 | Meyer et al. |
| 5,850,935 | A | 12/1998 | Luburic et al. |
| 5,875,913 | A | 3/1999 | Letica |
| 5,906,292 | A | 5/1999 | Rider, Jr. |
| 5,947,604 | A | 9/1999 | Bang et al. |
| 5,950,854 | A | 9/1999 | Rider, Jr. et al. |
| 6,021,917 | A | 2/2000 | Lovell et al. |
| 6,102,231 | A | 8/2000 | Rider, Jr. et al. |
| 6,112,933 | A | 9/2000 | Meyer et al. |
| D463,282 | S | 9/2002 | Mitchell |
| 6,604,647 | B1 | 8/2003 | Luburic |
| 6,644,491 | B2 | 11/2003 | Dewig et al. |
| 6,644,492 | B1 | 11/2003 | Mitchell |
| 6,688,483 | B2 | 2/2004 | Davis |
| 6,708,839 | B2 | 3/2004 | Diesterbeck |
| 6,712,233 | B2 | 3/2004 | Arshinoff |
| 6,779,680 | B1 | 8/2004 | Schwarz |
| 6,834,772 | B1 | 12/2004 | Thorse |
| 6,840,398 | B1 | 1/2005 | Blumenschein |
| 6,845,877 | B2 | 1/2005 | Diesterbeck |
| 6,886,708 | B2 | 5/2005 | Kaufman et al. |
| 7,007,817 | B2 | 3/2006 | Jochem |
| 7,134,567 | B2 | 11/2006 | Luburic |
| 7,198,170 | B2 | 4/2007 | Herr |
| 7,207,457 | B2 | 4/2007 | Schwarz |
| 7,303,088 | B2 | 12/2007 | Sawyer et al. |
| 7,344,039 | B2 | 3/2008 | Bixler et al. |
| D574,238 | S | 8/2008 | Walker et al. |
| 7,475,788 | B2 | 1/2009 | Schwarz |
| 7,475,789 | B2 | 1/2009 | Fischer |
| D595,128 | S | 6/2009 | Bouveret et al. |
| 7,549,547 | B2 | 6/2009 | Herr et al. |
| D598,282 | S | 8/2009 | Abrahamsson |
| D599,204 | S | 9/2009 | Georgiadis et al. |
| D603,168 | S | 11/2009 | Melhede et al. |
| 7,686,188 | B2 | 3/2010 | Stebick et al. |
| D617,209 | S | 6/2010 | Georgiadis et al. |
| 7,731,049 | B2 | 6/2010 | Dengel et al. |
| 7,740,149 | B2 | 6/2010 | Luburic |
| 2002/0148847 | A1 | 10/2002 | Luburic |
| 2008/0257886 | A1 | 2/2004 | Luburic |
| 2005/0124057 | A1 | 6/2005 | Sturk et al. |
| 2005/0161455 | A1 | 7/2005 | Studee |
| 2006/0076260 | A1 | 4/2006 | Luburic |
| 2007/0012710 | A1 | 1/2007 | Vovan |
| 2007/0062949 | A1 | 3/2007 | Bordner |
| 2007/0144996 | A1 | 6/2007 | Sawyer |
| 2007/0251911 | A1 | 11/2007 | Russell |
| 2008/0006632 | A1 | 1/2008 | Vovan |
| 2008/0047976 | A1 | 2/2008 | Scheer et al. |
| 2008/0116163 | A1 | 5/2008 | Sawyer |
| 2008/0149639 | A1 | 6/2008 | Luburic |
| 2008/0179337 | A1 | 7/2008 | Vuillot et al. |
| 2008/0190803 | A1 | 8/2008 | Blumenschein |
| 2008/0190804 | A1 | 8/2008 | Blumenschein |
| 2008/0264961 | A1 | 10/2008 | Sawyer |
| 2008/0302753 | A1 | 12/2008 | Jochem et al. |
| 2009/0014456 | A1 | 1/2009 | Woinarski |
| 2009/0032532 | A1 | 2/2009 | Abrahamsson et al. |
| 2009/0032534 | A1 | 2/2009 | Luburic |
| 2009/0039051 | A1 | 2/2009 | Habitz et al. |
| 2009/0152280 | A1 | 6/2009 | Luburic |
| 2009/0206082 | A1 | 8/2009 | Vovan |
| 2009/0308883 | A1 | 12/2009 | Blumenschein |
| 2009/0314780 | A1 | 12/2009 | Selina et al. |
| 2010/0025355 | A1 | 2/2010 | Beecroft |
| 2010/0051572 | A1 | 3/2010 | Beecroft et al. |
| 2010/0147851 | A1 | 6/2010 | Blumenschein |

FOREIGN PATENT DOCUMENTS

| | | |
|---|---|---|
| CA | 2279029 | 5/1995 |
| CA | 2191149 | 12/1996 |
| CA | 2198822 | 1/1998 |
| CA | 2353537 | 6/2000 |
| CA | 2361685 | 8/2000 |
| CA | 2415581 | 1/2002 |
| CA | 2375965 | 9/2002 |
| CA | 2383732 | 10/2002 |
| CA | 2404876 | 10/2002 |
| CA | 2470130 | 6/2003 |
| CA | 2478441 | 9/2003 |
| CA | 2425492 | 10/2003 |
| CA | 2485422 | 11/2003 |
| CA | 2493063 | 2/2004 |
| CA | 2493343 | 2/2004 |
| CA | 2491184 | 7/2005 |
| CA | 2551700 | 7/2005 |
| CA | 2551717 | 7/2005 |
| CA | 2459201 | 8/2005 |
| CA | 2511987 | 1/2006 |
| CA | 2515089 | 2/2006 |
| CA | 2522230 | 4/2006 |
| CA | 2549310 | 12/2006 |
| CA | 2549447 | 12/2006 |
| CA | 2558048 | 2/2007 |
| CA | 2565256 | 6/2007 |
| CA | 2569957 | 6/2007 |
| CA | 2633081 | 6/2007 |
| CA | 2565664 | 1/2008 |
| CA | 2562328 | 4/2008 |
| CA | 2672991 | 7/2008 |
| CA | 2676410 | 8/2008 |
| CA | 2676846 | 8/2008 |
| CA | 2685172 | 11/2008 |
| CA | 2679213 | 3/2010 |
| EP | 1052183 | 11/2000 |
| EP | 2030908 | 3/2009 |
| GB | 2040267 A | 8/1980 |
| WO | 2004000675 | 12/2003 |
| WO | 2005056414 | 6/2005 |
| WO | 2005082734 | 9/2005 |
| WO | WO-2005082733 A1 | 9/2005 |
| WO | 2008095478 | 8/2008 |
| WO | 2008095483 | 8/2008 |
| WO | 2008095484 | 8/2008 |
| WO | 2009056115 | 5/2009 |
| WO | 2009075686 | 6/2009 |
| WO | 2009075849 | 6/2009 |
| WO | 2009129779 | 10/2009 |
| WO | 2009150204 | 12/2009 |
| WO | 2009152798 | 12/2009 |
| WO | 2009156401 | 12/2009 |

TAMPER EVIDENT SYSTEM AND METHOD

CROSS-REFERENCE TO RELATED APPLICATIONS

This application is a National Entry Application of PCT application no PCT/CA2011/050184 filed on Apr. 5, 2011 and published in English under PCT Article 21(2) under number WO 2011/127597, which itself claims benefit of U.S. provisional application Ser. No. 61/323,491, filed on Apr. 13, 2010. All documents above are incorporated herein in their entirety by reference.

FIELD OF THE INVENTION

The present invention relates to a tamper evident system and method. More precisely, it relates to a tamper evident container.

BACKGROUND OF THE INVENTION

There has been ongoing efforts to develop tamper evident packaging in order to know that a product has not been altered since it left the manufacturer, in a number of fields, including for example, the food industry and the pharmaceutical industry.

Wilson (WO 200582733) describes a container having a base, a cover and anchoring formations, the base having an opening adapted to be closed by the cover, a first anchoring formation being attached to the cover by means of a frangible connection, the anchoring formations coupling together to the base and the cover in the closed position of the cover on the base, so that opening the container disrupts the frangible connection leaving the anchoring formations coupled together and allowing the base to be at least partially detached from the cover, leaving the disrupted frangible connection as evidence that the container has been opened.

Parikh et al. (CA 2,679,213) also uses anchoring formations and a frangible connection, and once opened, the container may not be completely closed again.

Bordner (US 2007/0062949) uses a cover comprising a pull tab having an opening and a rib on the pull tab adapted to detachably engage the container. Upon lifting the cover from the closed container by pulling on the pull tab, the rib is disengaged from the container thereby deforming the pull tab.

There is still a need in the art for a tamper evident system and method.

SUMMARY OF THE INVENTION

More specifically, in accordance with the present invention, there is provided a container comprising a lid comprising a central portion and a circumferential rim, the rim comprising an aperture at least at one location around a perimeter of the rim; and a body comprising a base and lateral walls extending up from the base and ending up in a rim, the rim comprising a knob at least at one location thereof; wherein, in a closed position of the lid over the body, the knob is received in the aperture and is seen emerging from the aperture, and, upon lifting the lid up from the closed position for the first time, the knob disengages from the aperture, thereby deforming at least one of the aperture and the rim of the lid, the deformed part testifying of a first opening of the container.

There is further provided a method of evidencing opening of a container having a body and a lid, comprising providing a lid comprising a central portion and a circumferential rim, and providing an aperture at least at one location of the rim; providing a body of a shape corresponding to the lid, and comprising a base and lateral walls extending up from the base and ending up in a rim, and providing a knob at least at one location of the rim; and positioning the lid over the body so that the knob is received in the aperture and the knob is seen emerging from the aperture, in a closed never opened position of the container; whereby, upon lifting the lid up from the closed position, the knob disengages from the aperture, thereby deforming at least one of the aperture and the rim of the lid.

Other objects, advantages and features of the present invention will become more apparent upon reading of the following non-restrictive description of specific embodiments thereof, given by way of example only with reference to the accompanying drawings.

BRIEF DESCRIPTION OF THE DRAWINGS

In the appended drawings:

FIGS. 9*a*-9*d* are a close up views of a lid for a container according to further embodiments of an aspect of the present invention

DESCRIPTION OF ILLUSTRATIVE EMBODIMENTS

The present invention is illustrated in further details by the following non-limiting examples.

Figure 1:
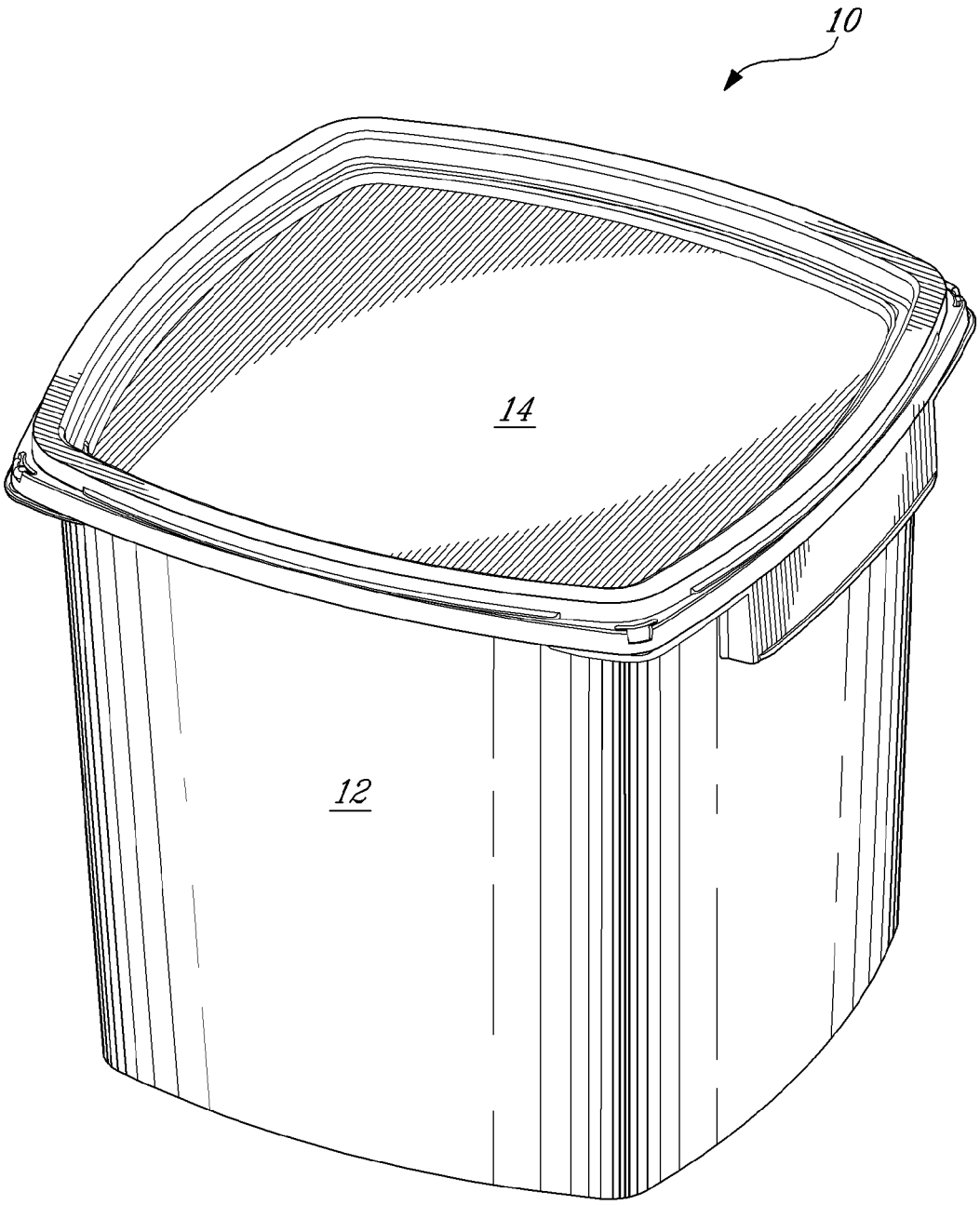
FIG. 1 is a perspective view of a container according to an embodiment of an aspect of the present invention.

As shown in FIG. 1, a container 10 generally comprises a body 12 and a lid 14.

The container may have a range of shapes, including for example parallelepiped as illustrated herein. It may also be round or have a horseshoe shape or any combinations of shapes.

Figure 2:
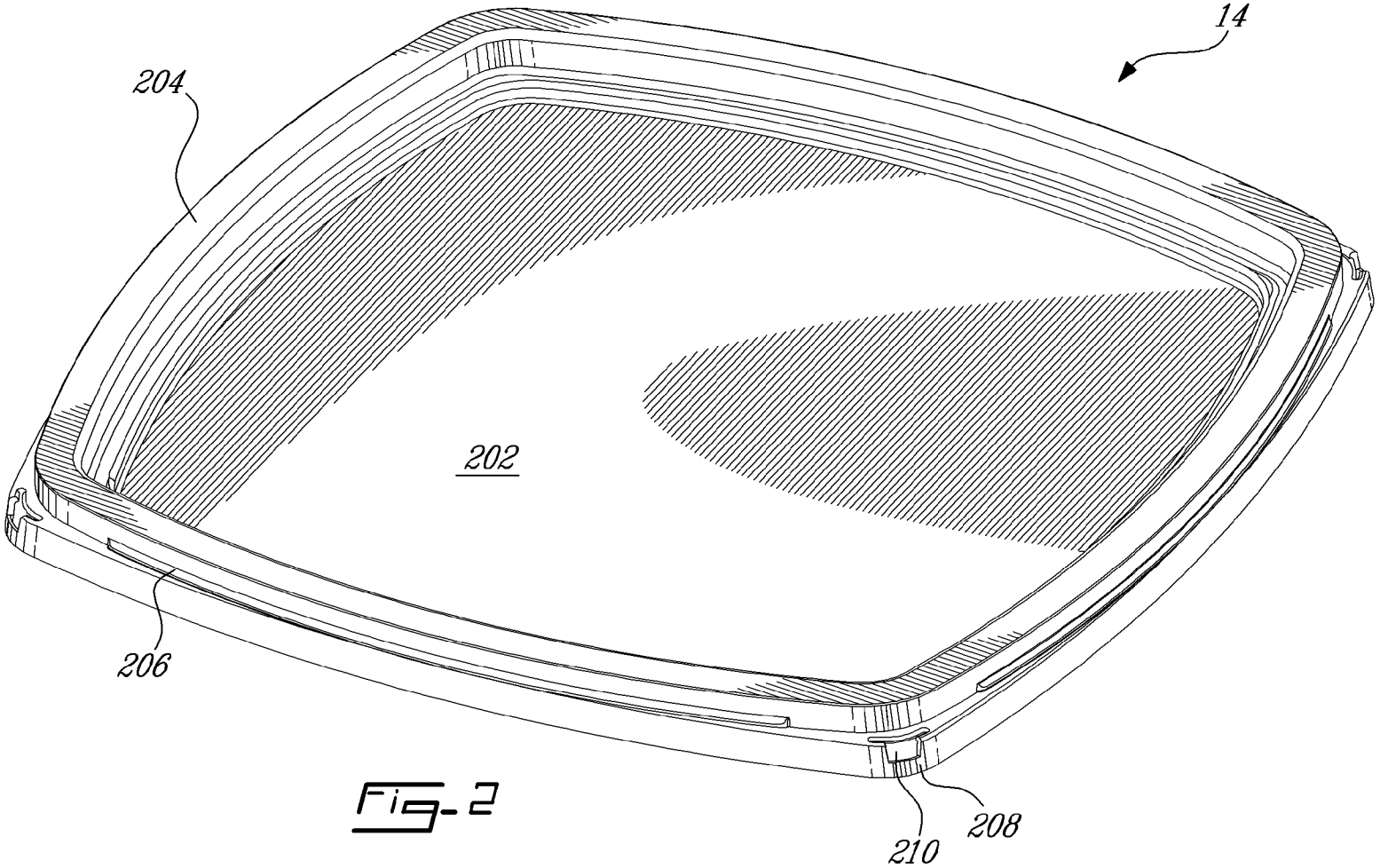
FIG. 2 is a perspective view of a lid for a container according to an embodiment of an aspect of the present invention.

As shown in FIG. 2, the lid 14 comprises a central portion 202, a rim 204 and a flange 206 extending downwards from the rim 204. The central portion 202 may have a generally parallelepiped shape. The central portion 202 may also be round or ovoid, depending on the shape of the body 12 of the container 10 as mentioned hereinabove.

Figure 3:
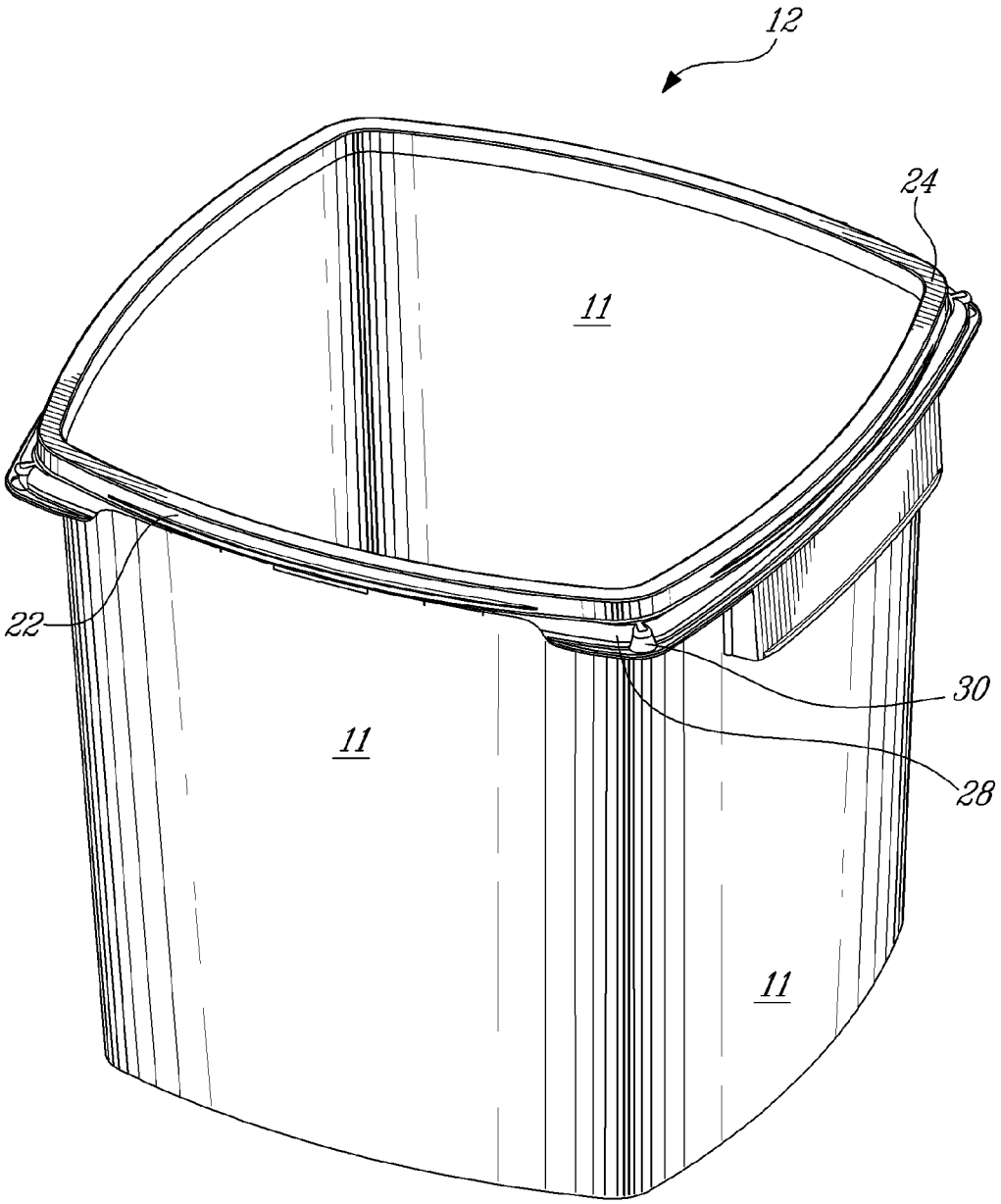
FIG. 3 is a perspective view of a body for a container according to an embodiment of an aspect of the present invention.

As shown in FIG. 3, the body 12 comprises lateral walls 11 extending up from a base. The lateral walls 11 comprise an upper flange 22 extending from a rim 24 on at least part of the perimeter of the rim 24.

Figure 4:
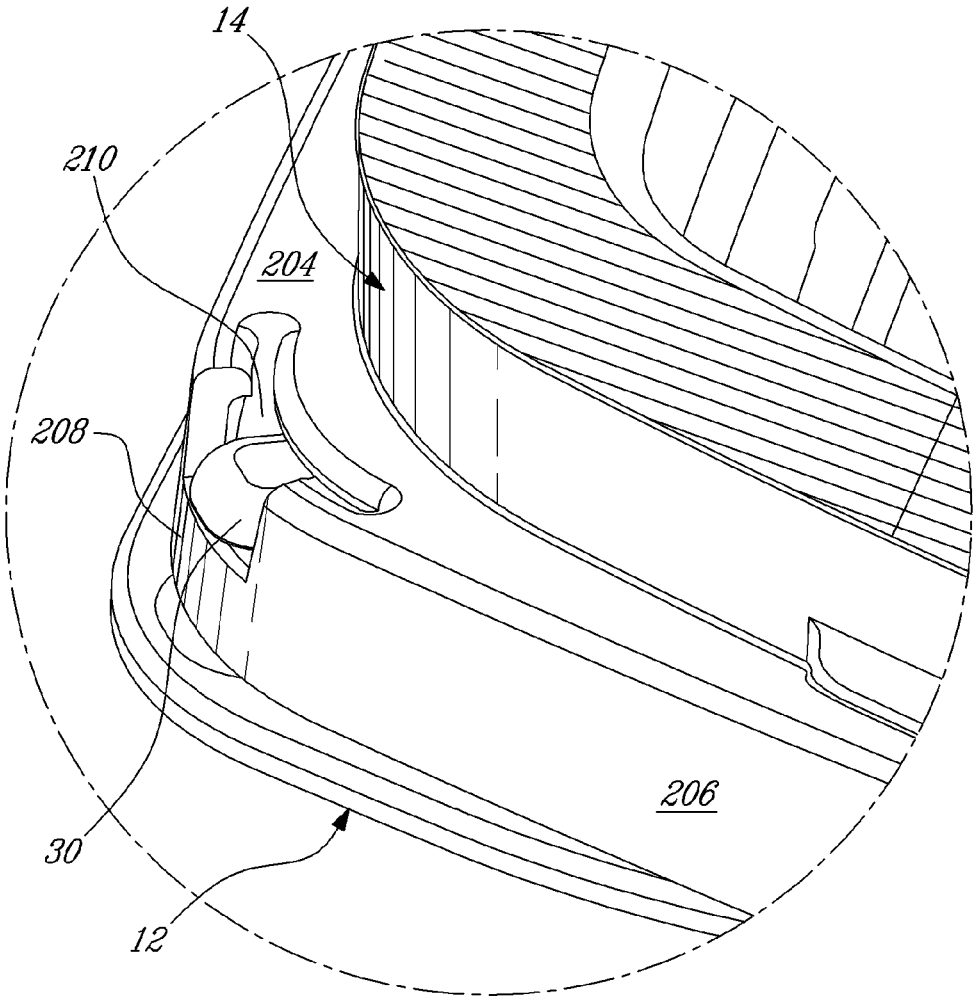
FIG. 4 is a close up view of a container in a closed position thereof according to an embodiment of an aspect of the present invention.

FIG. 4 shows the lid 14 on the body 12 in a closed position of the container 10. In this closed position of the container 10, the rim 204 of the lid 14 generally comes into a sitting position on the rim 204 of the body 12 of the container 10.

Figure 5A:
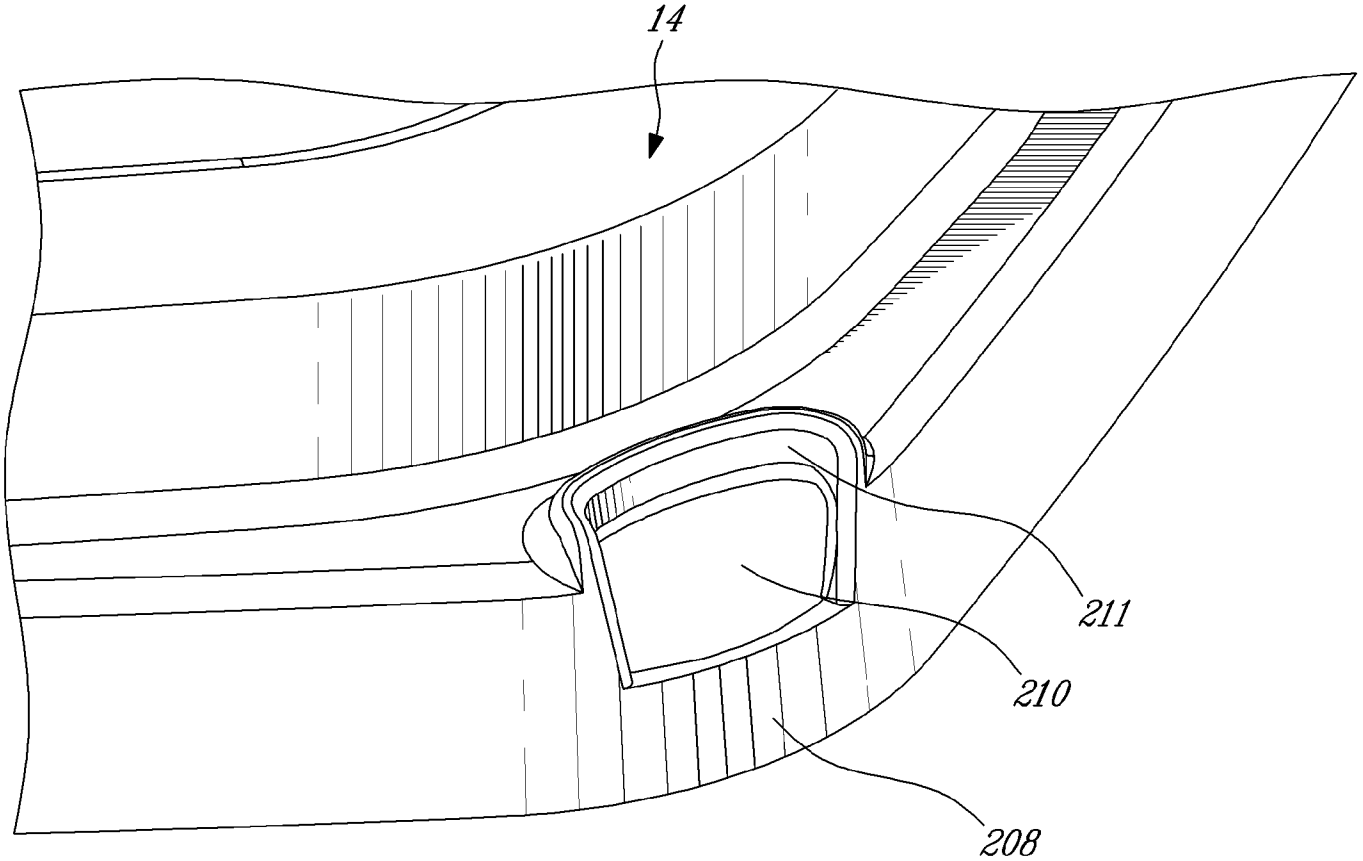
FIGS. 5*a*, 5*b* and 5*c* are a close up views of a lid for a container according to embodiments of an aspect of the present invention.
Figure 5B:
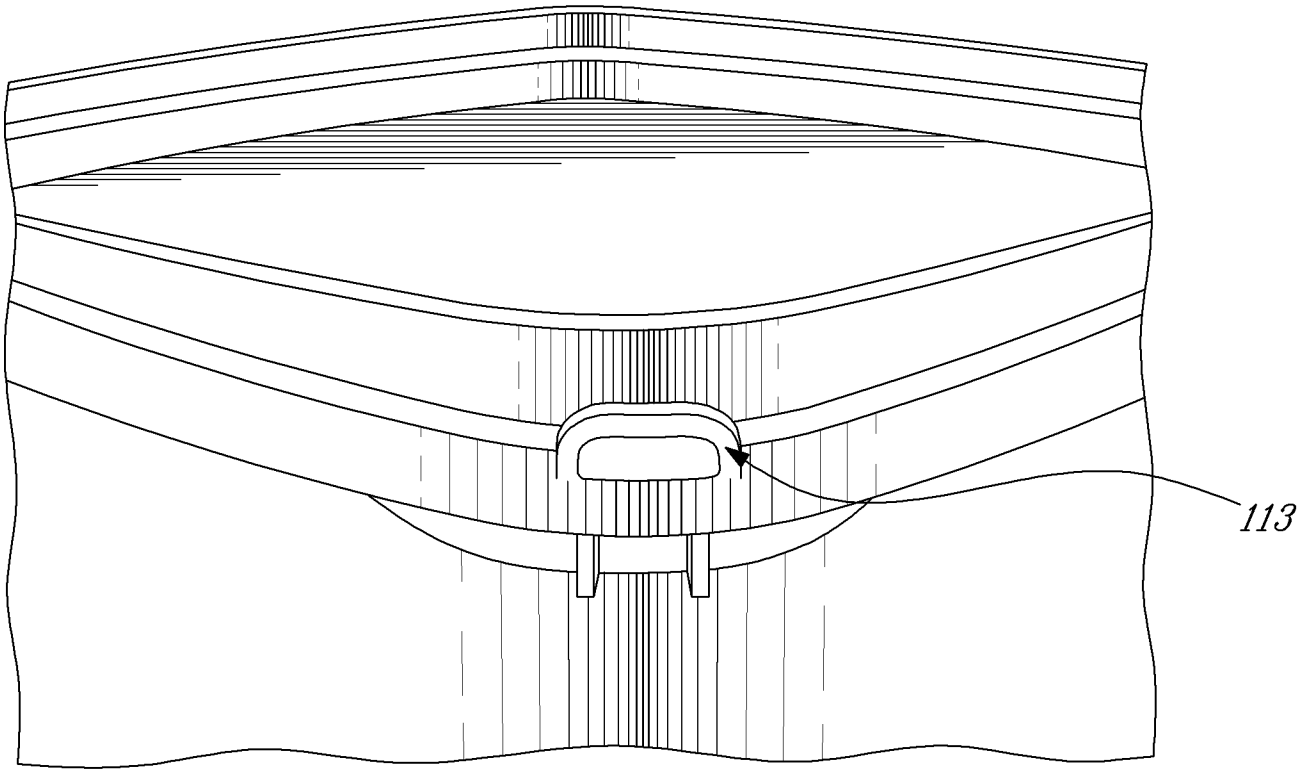
Figure 5C:
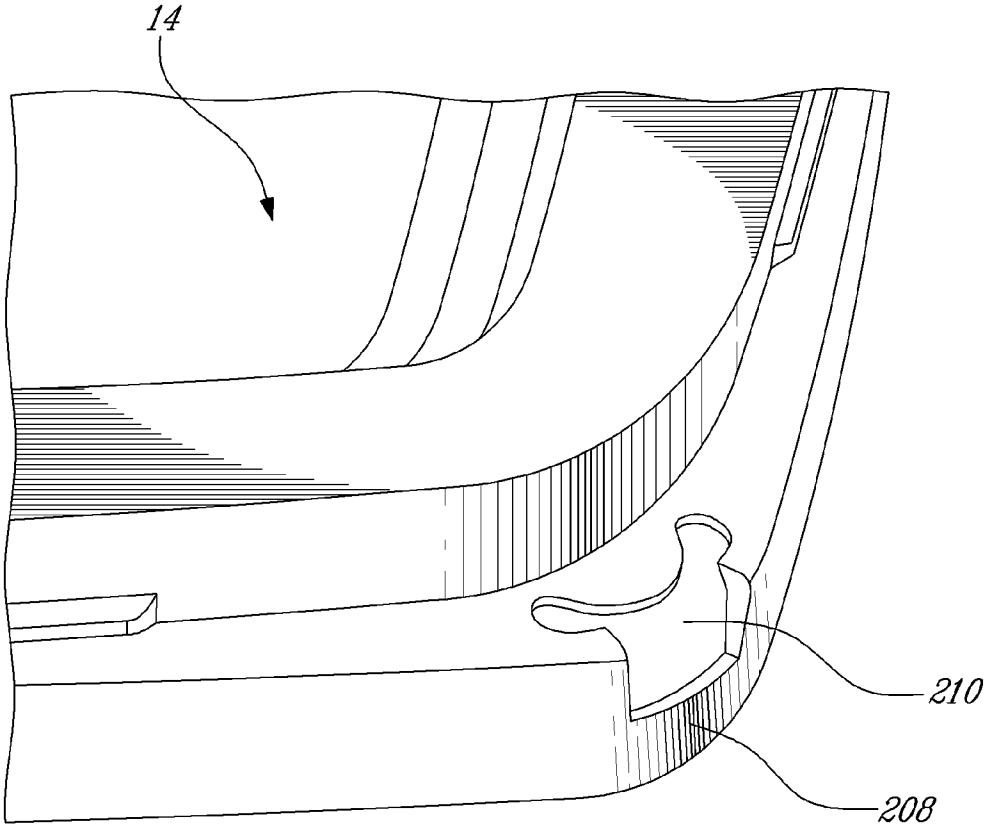
Figure 6A:
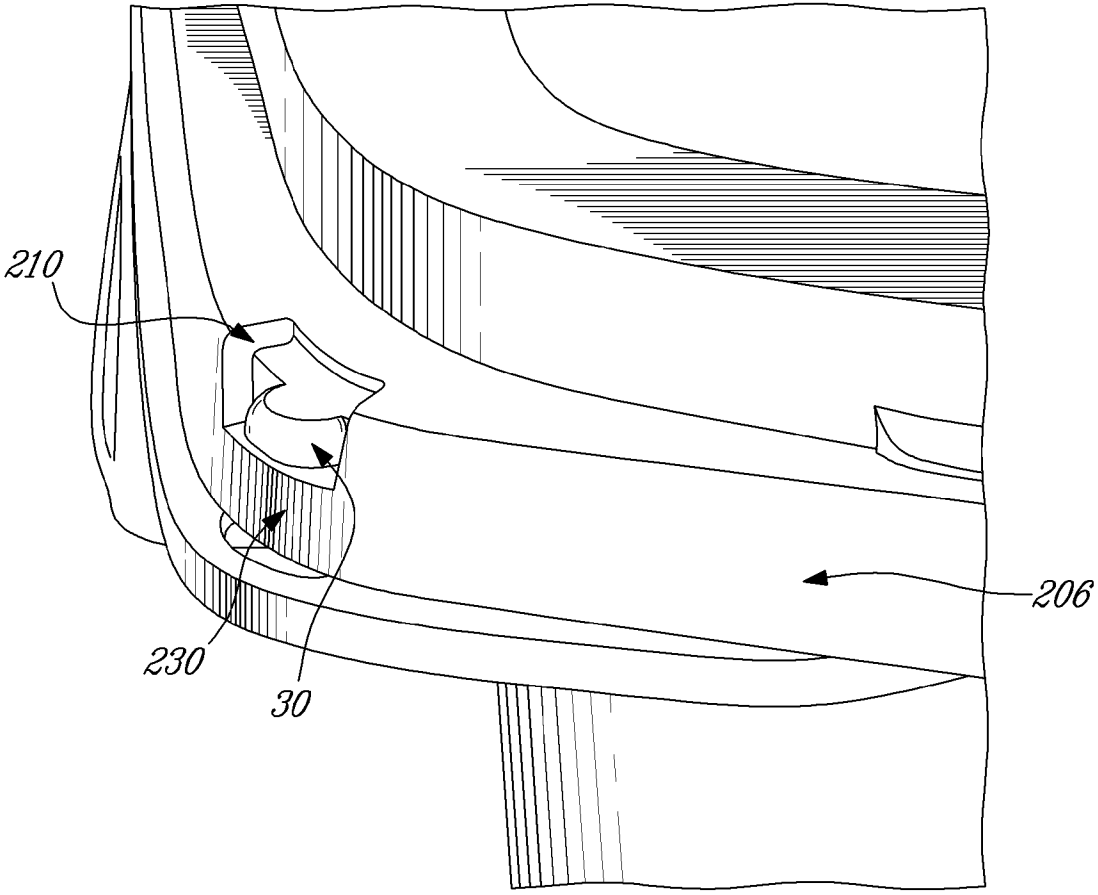
FIGS. 6*a*-6*e* are close up views of a container in a closed position thereof according to further embodiments of an aspect of the present invention
Figure 6B:
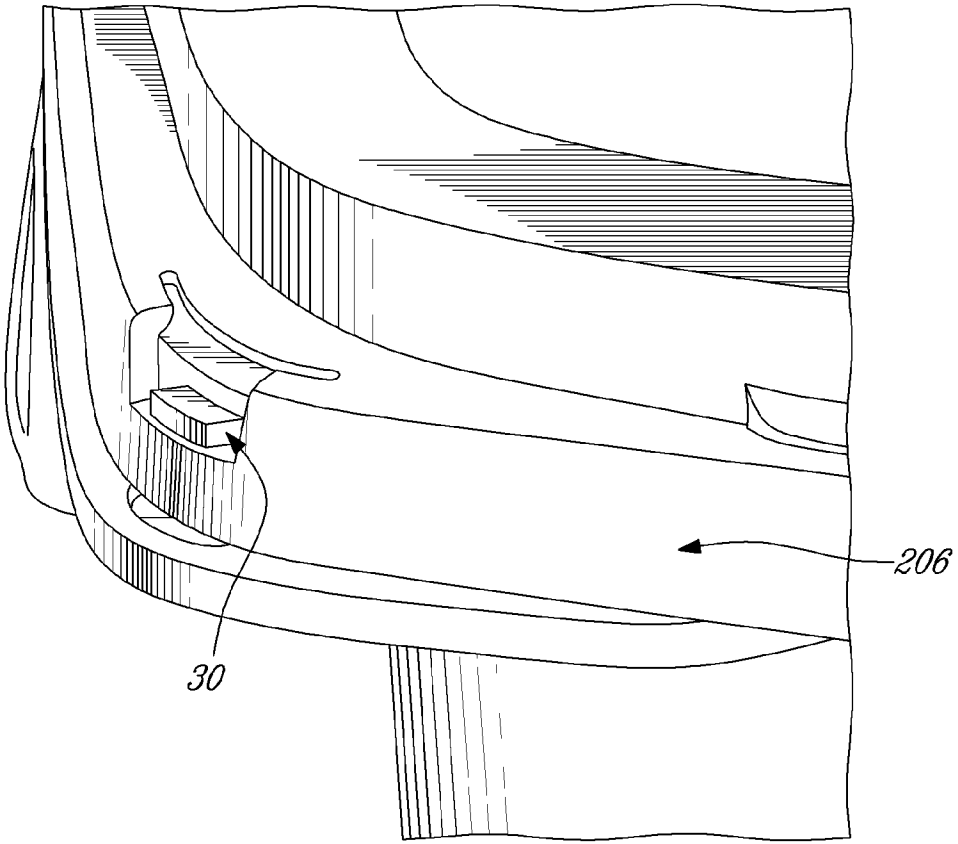
Figure 6C:
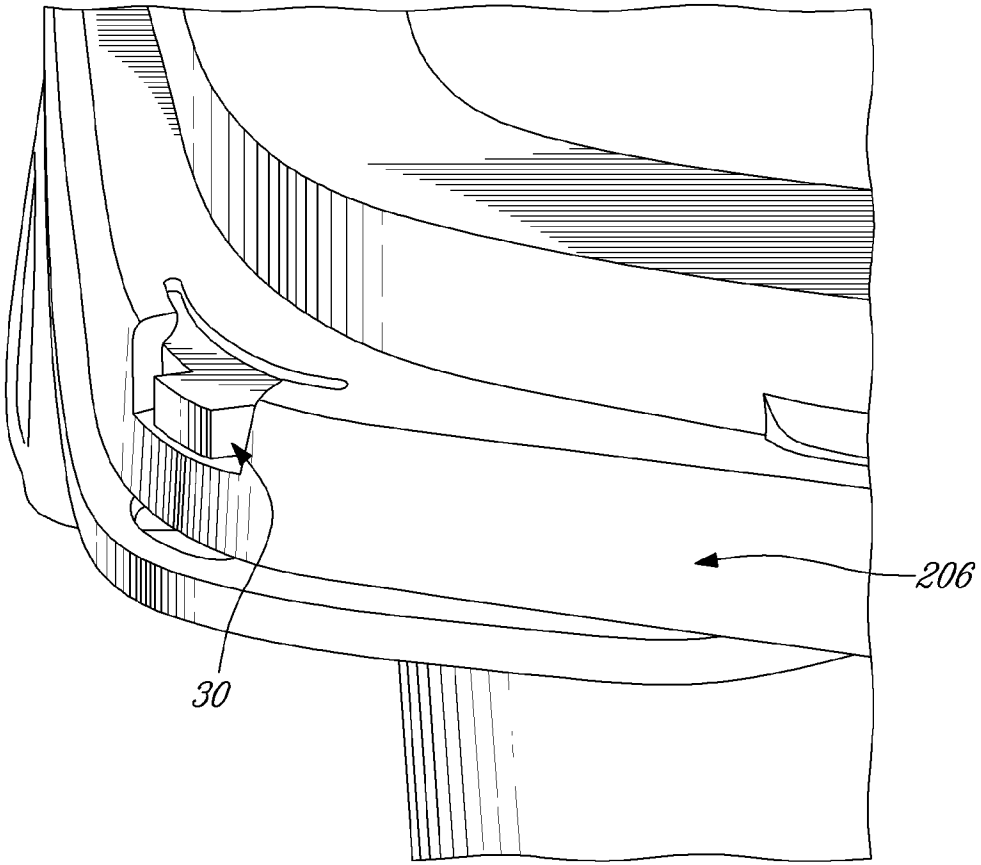
Figure 6D:
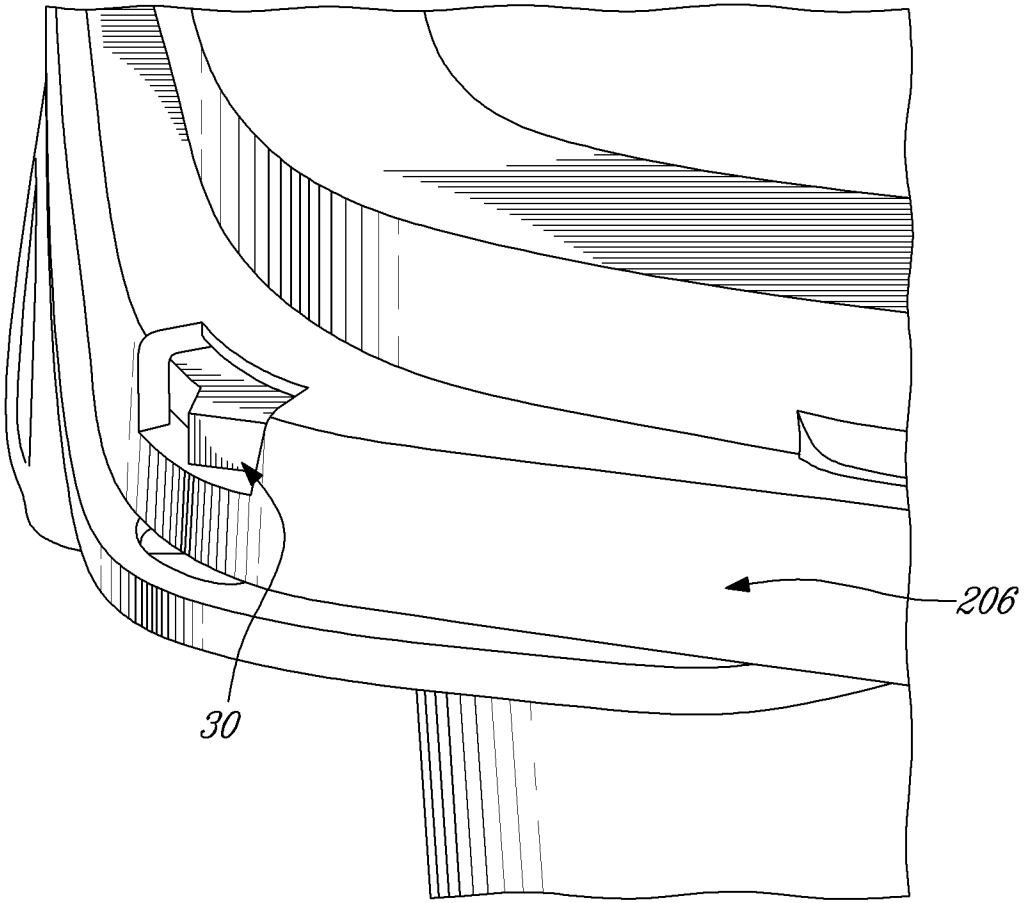
Figure 6E:
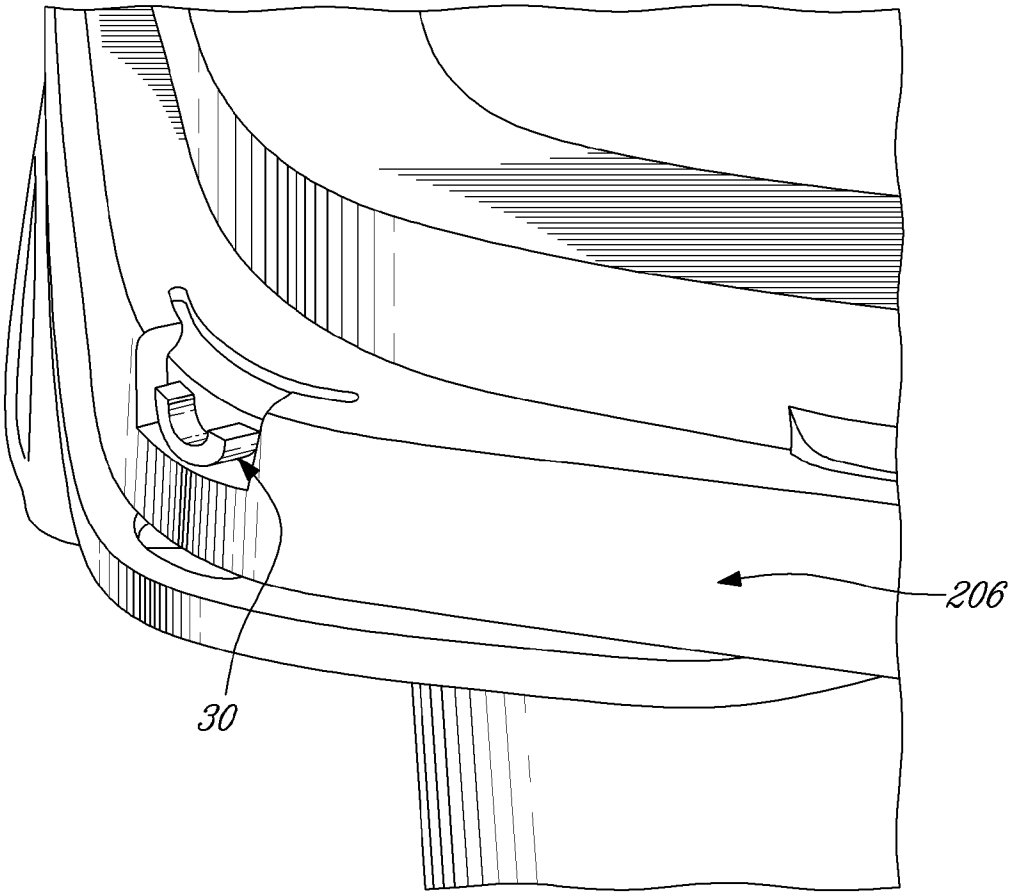
Figure 7:
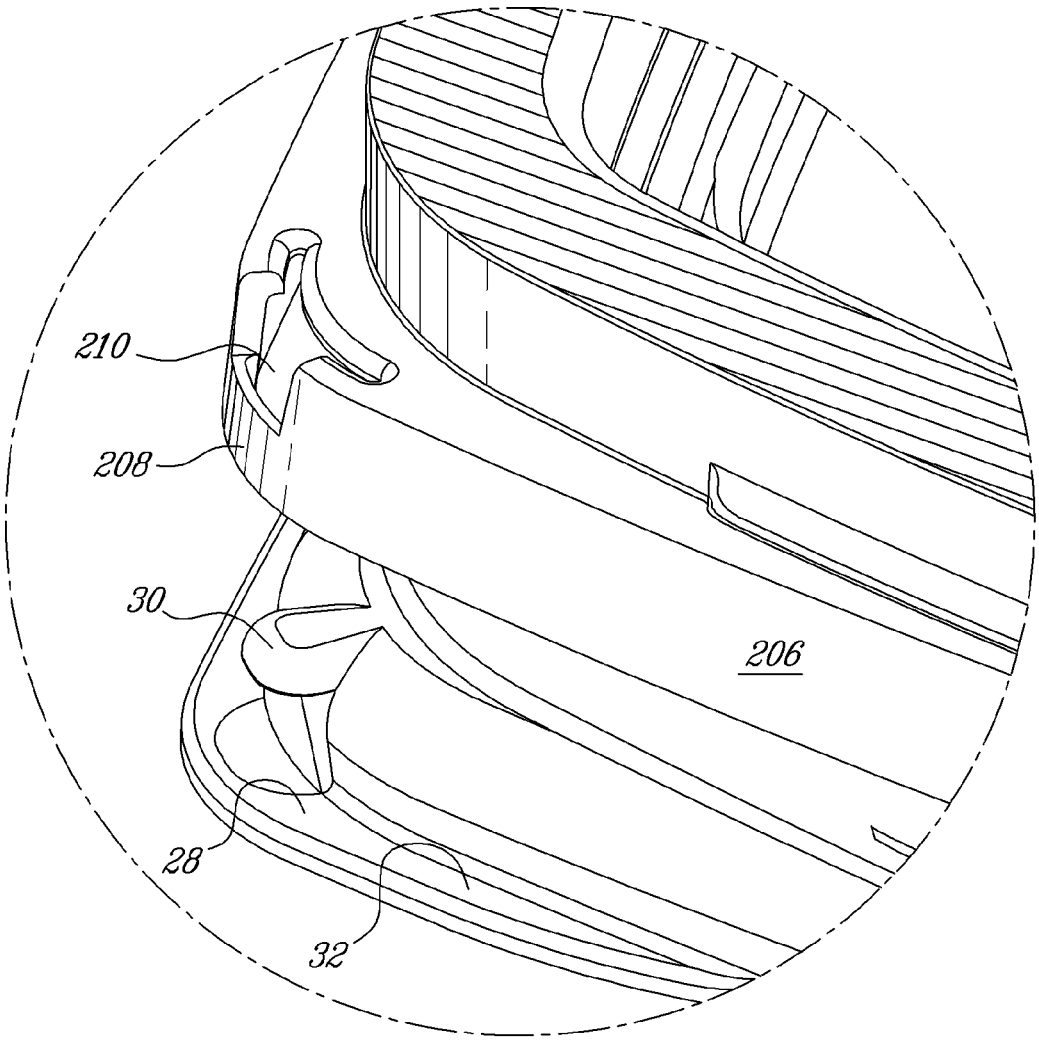
FIG. 7 is a close up view of the container of FIG. 1 before assembly of the lid over the body thereof.

As best seen in FIGS. 2 and 7, at least at one location around its perimeter, the flange 206 of the lid 14 comprises an aperture 210 and a portion 208 located below this aperture 210. As exemplified in FIG. 5, the aperture 210 may have a range of shapes. In FIG. 5*a*, the aperture 210 is shown with a rib 211 located in an horizontal plane for example, while in FIG. 5*b* it is shown with a rib 113 in a vertical plane, and in FIG. 5*c*, there is no rib.

The aperture 210 is adapted to receive a knob 30, best seen in FIG. 3, supported by a lateral wall 11 at a corresponding location of the flange 22 of the body 12 when the lid 14 is in position over the body 12 in the closed position of the container 10 (see FIGS. 4, 6*a*-6*e*, 9*a*-9*d*). As illustrated in FIG. 6, the knob 30 may have a range of shapes.

When the container 10 is properly closed, i.e. when the lid 14 is properly secured over the body 12, the knob 30 is seen emerging from the aperture 210 (see FIG. 4). This evidences proper closure of the container 10.

Upon removal of the lid 14 by grasping the flange 206 to lift the lid 14 from its position over the body 12 in the closed position of the container 10, the knob 30 forces on the portion 208 of the flange 206 of the lid 14 when the knob 30 disengages itself from the aperture 210 in the flange 206 of the lid 14.

Figure 8:
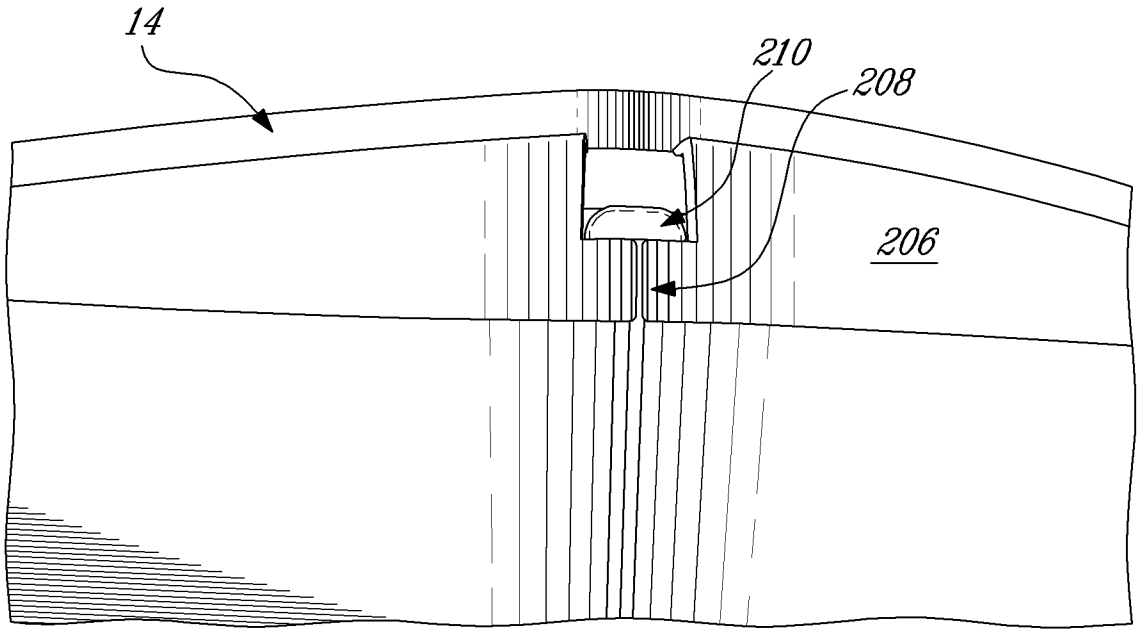
FIG. 8 is a close up of the lid of a container after first removal thereof according to an aspect of an embodiment of the present invention.

In an embodiment of the present invention, by providing that this portion 208 is of a reduced thickness relative to the remaining of the flange 206, for example, the knob 30 thus forcing on the portion 208 stretches the material in this portion 208, to the point of breakage of the portion 208 as illustrated in FIG. 8 for example, or not. In either case, as the lid 14 is thus removed from the body 12, the damaged portion 208, either deshaped by stretching or even split off. The damaged portion 208 may remain attached to the lid 14 and the state of the portion 208 testifies of the opening of the container 10. Alternatively, the damaged portion 208 may separate from the lid 14.

It is found that while positioning the lid 14 into a secure position over the body 12, i.e. by engaging the knob 30 into the aperture 210, the forces exerted on the lid 14 are generally uniformly distributed and the portion 208 does not get visibly or irreversibly deformed. In contrast, when a user pulls on the lid 14 to open the container 10, this pulling force causes the portion 208 to deform as it passes the protruding knob 30 of the body 12 and this deformation may even cause the portion 208 to break, as mentioned hereinabove. The portion 208 remains attached to the rim 206 of the lid 14 as shown in FIG. 8. The deformation or breaking of the portion 208 allows to easily determine whether the lid 14 has been opened, i.e. whether there has been tampering.

In the above described embodiment, the stretching or even breaking of the portion 208 may be due to a reduced thickness of this portion 208 compared to the remaining part of the flange 206 of the lid 14. The portion 208 may even be of the same thickness than the remaining part of the flange 206 of the lid 14, in cases of a very thinned walled container for example. Being located at a position where the protruding knob 30 of the body 12 passes upon pulling on the lid 14 to open the container 10, this portion 208 is irreversibly deformed upon removal of the lid 14.

In an alternative embodiment, the portion 208 may comprise a weakening line 230, which would similarly be deformed or even broken upon passage of the knob 30.

In another embodiment, the portion 208 may be a portion of the flange 206 of the lid 14 with a series of accordion-like plies, such as in bellows for example, (see FIG. 9*a*), so that, when the portion 208 passes by the knob 30 upon lifting of the lid 14, the knob 30 unfolds the plies, thereby testifying of tampering.

Figure 9A:
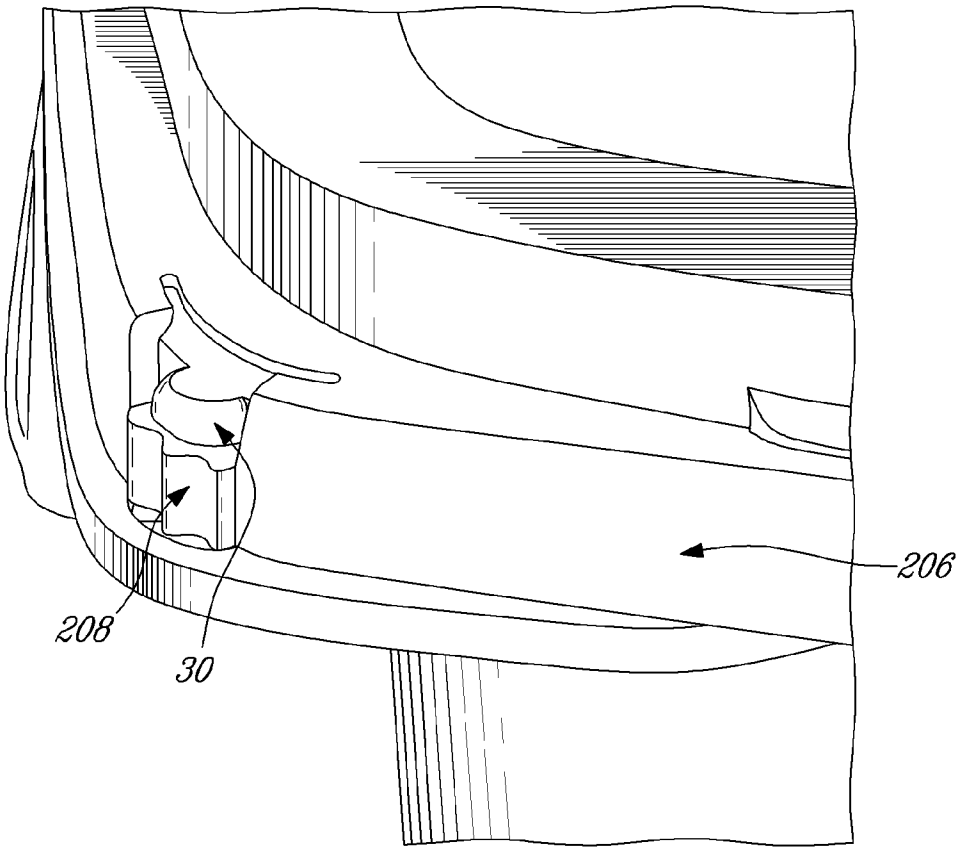
Figure 9B:
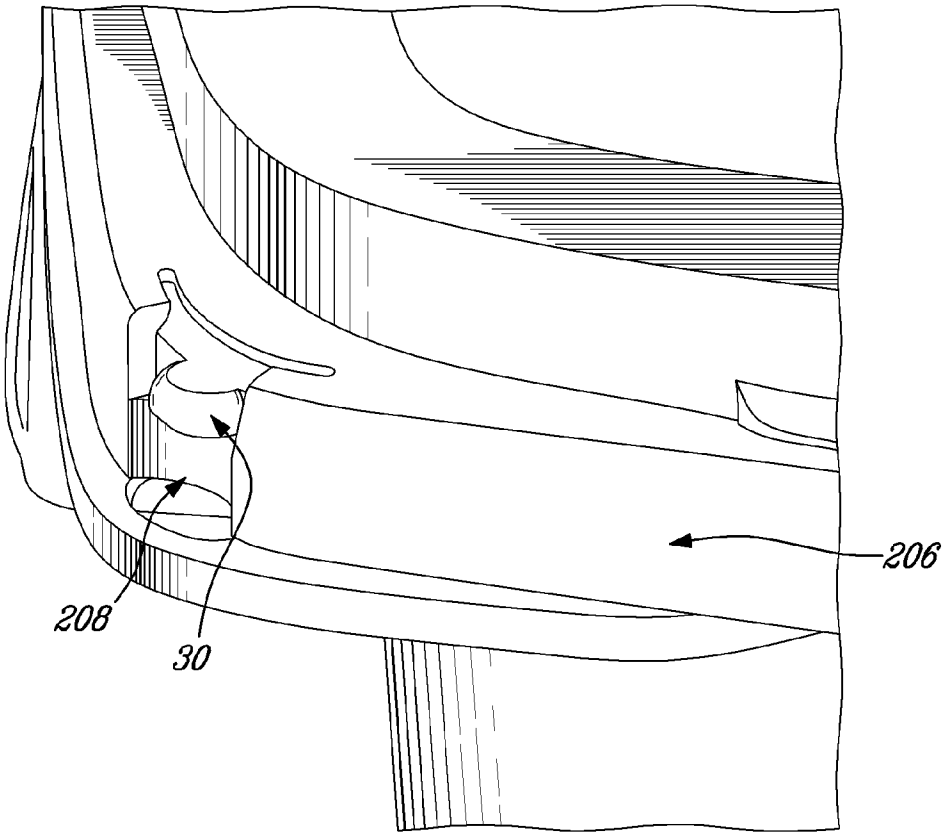
Figure 9C:
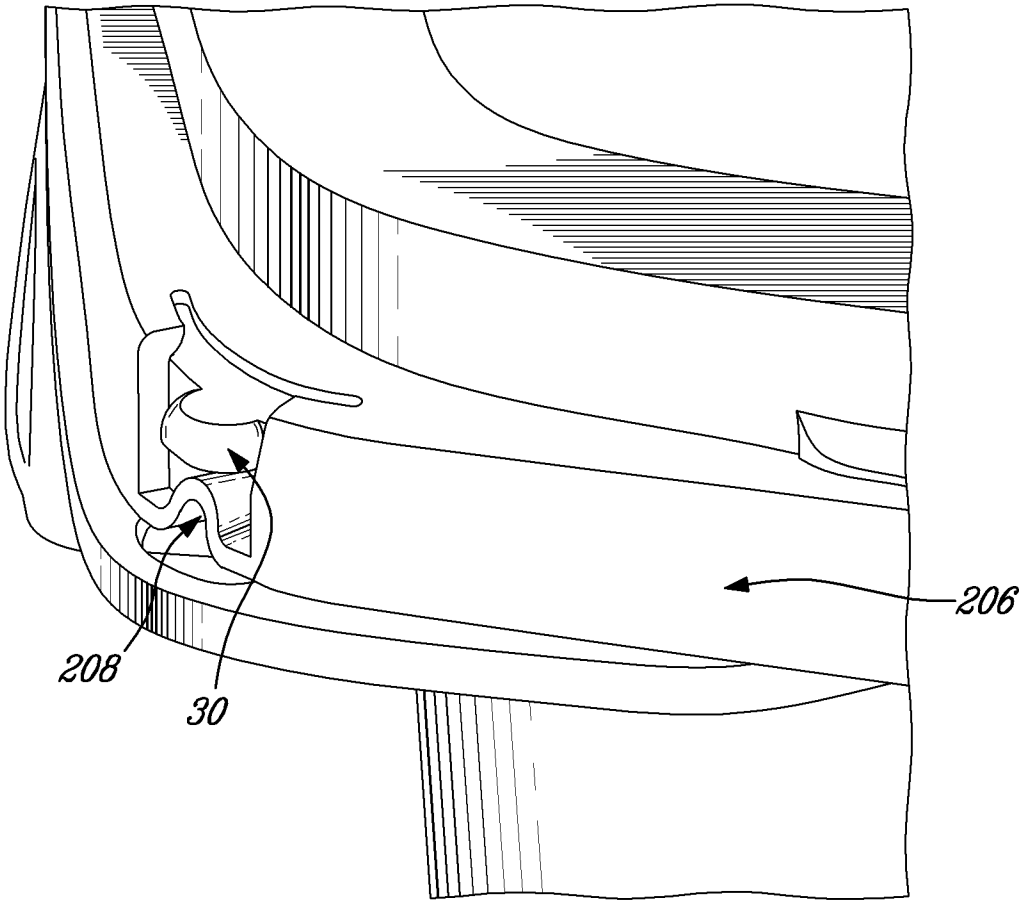
Figure 90:
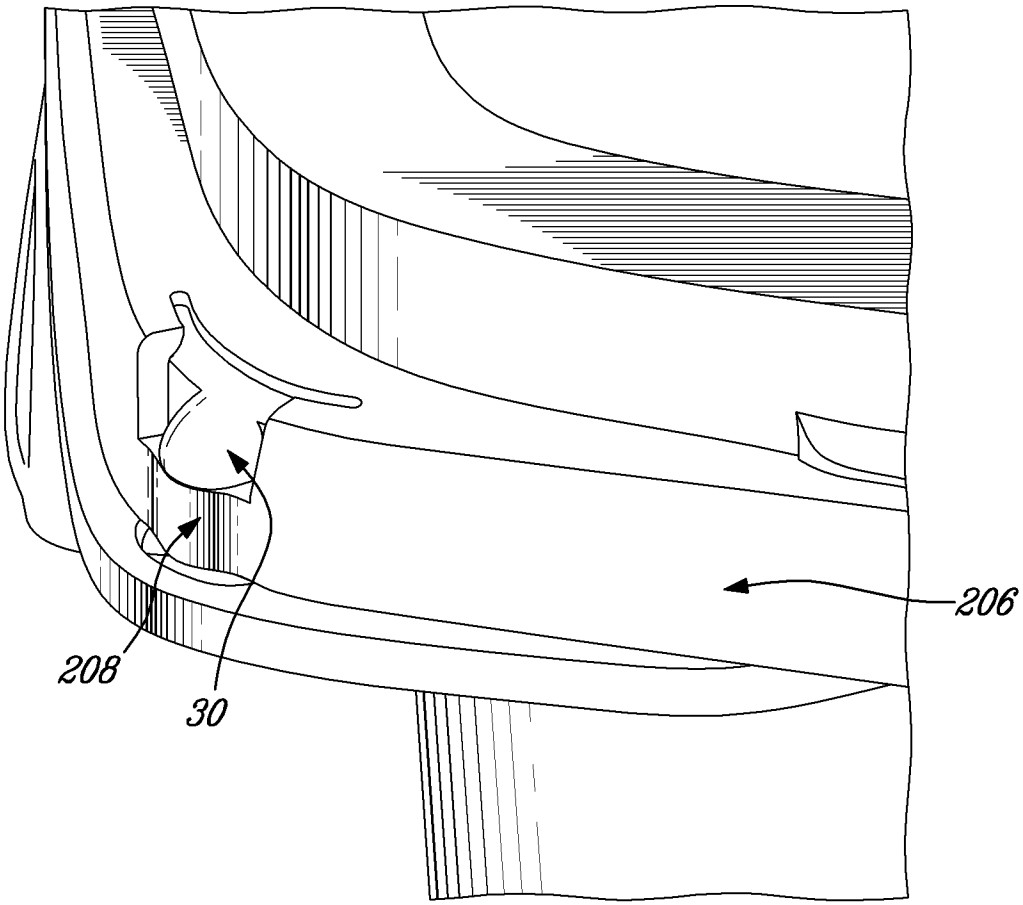

In FIG. 9*b*, the portion 208 is shown as a portion of the flange 206 with an inward radius of curvature, FIG. 9*c* shows an S shaped portion 208, and FIG. 9*d* shows a V shaped portion 208.

The deforming feature of the body 12 is described hereinabove as a knob 30. It may be any protuberance (see for example FIG. 6*a*-6*e*), or a localized curvature variation, on the flange 22 of the body 12, able to force on a portion of the flange 206 of the lid 14 as this portion passes by it as it emerges from the aperture 210 as the lid 14 is lifted from the body 12.

Figure 10A:
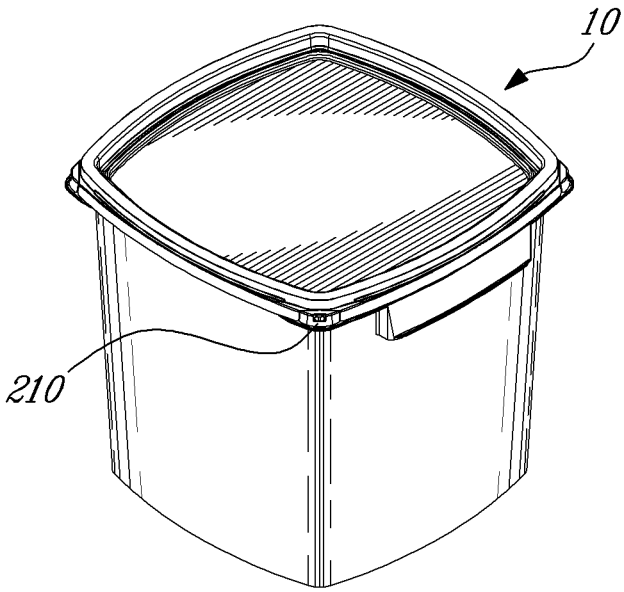
FIGS. 10*a*-10*d* show details of a container according to a further embodiment of the present invention.
Figure 10B:
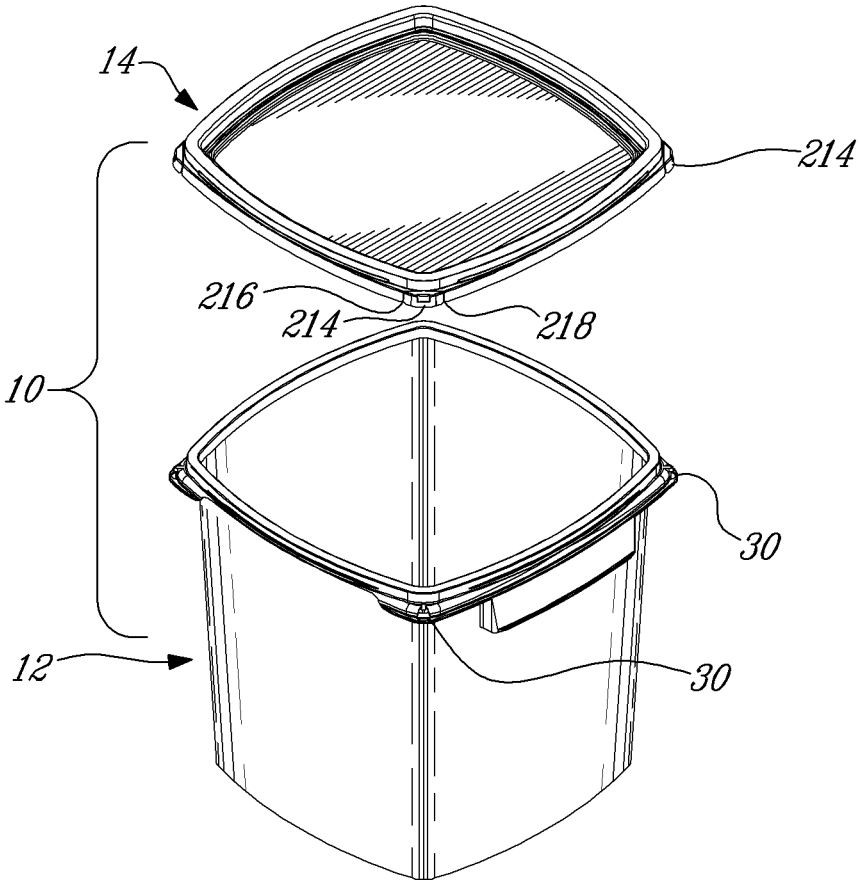
Figure 10C:
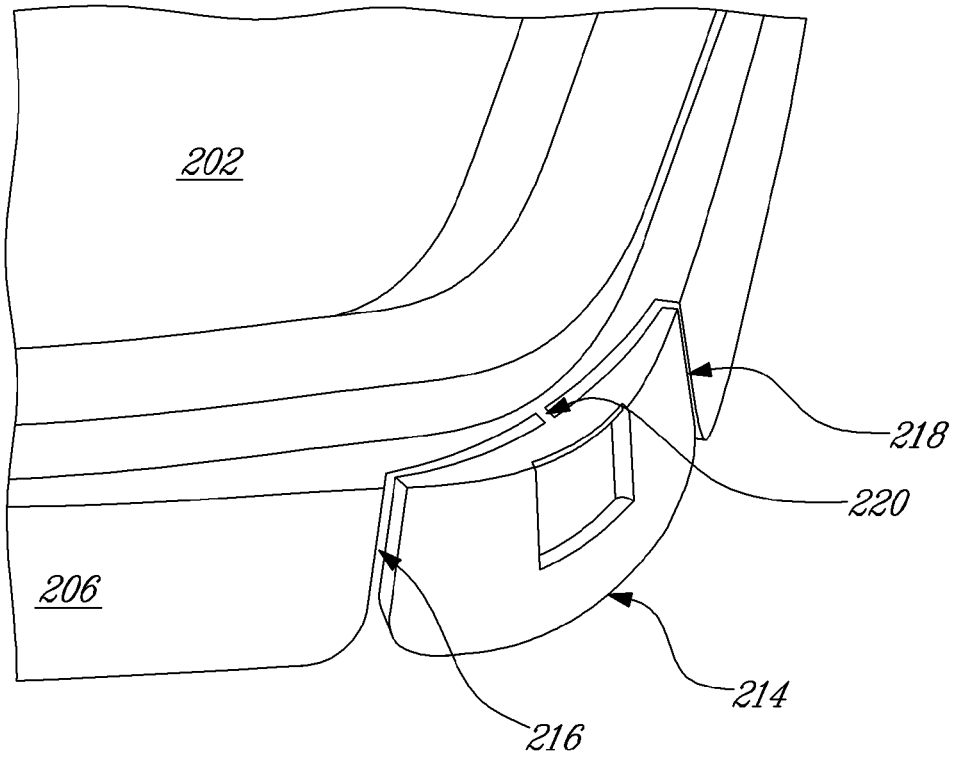
Figure 10D:
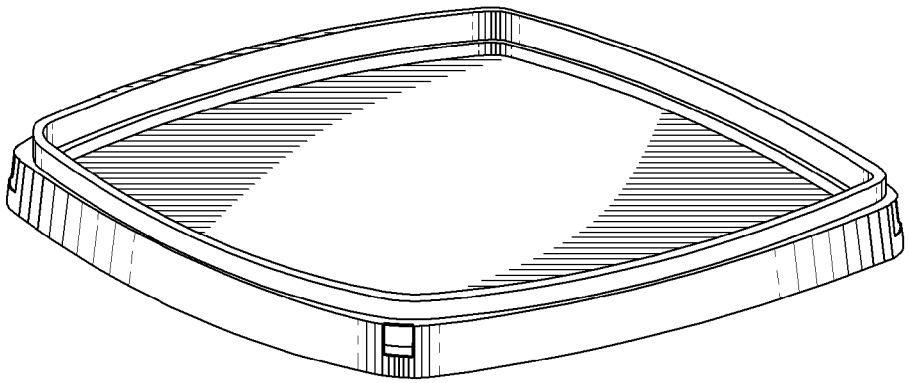

In still another embodiment illustrated for example in FIG. 10, instead of a portion 208 located below the aperture 210, the aperture 210 may be located on a break tab 214 defined by one or more weakening lines 216, 218. Upon lifting the lid 14, the knob 30 then forces on the aperture 210 to disengage itself therefrom, thereby stretching the material of the flange 206 of the lid about the aperture 210, and even tearing off at least one of the weakening lines. By providing a bridge 220 between the break tab 214 and the body 202 of the lid 14, the break tab 214 remains attached to the lid 14 even when all weakening lines 216, 218 are broken. The weakening lines 214, 216 may be visible to a user, as shown in FIG. 10*c*, or on the inside of the flange 206 as shown on FIG. 10*d*, for a leaner look.

As people in the art will appreciate, any combinations of the embodiments illustrated in FIGS. 5-9 for example can be contemplated.

The present invention provides evidence of a first opening of the container 10, without interfering with its original characteristics, such as sealing properties for example. Thereafter, the container 10 may still be closed and reopened again.

The body 12 comprises at least one knob 30, and the rim 206 of the lid 14 comprises at least the same number of apertures 210 and portions 208. For ease of handling by the user, the rim 206 of the lid 14 may comprise more apertures 210 and portions 208 than the number of knobs, so that the user does not need to orient the lid 14 when closing the container 10.

Typically, to open the container 10 closed by the lid 14, a user may pull anywhere on the rim 206 of the lid 14 where there is an access, including on portions 208 themselves, to open the lid 14 and at least one of the portions 208 will be stretched or broken as a result, evidencing opening. Access may be limited by a ridge as shown in 32 for example (see FIG. 7).

Figure 11A:
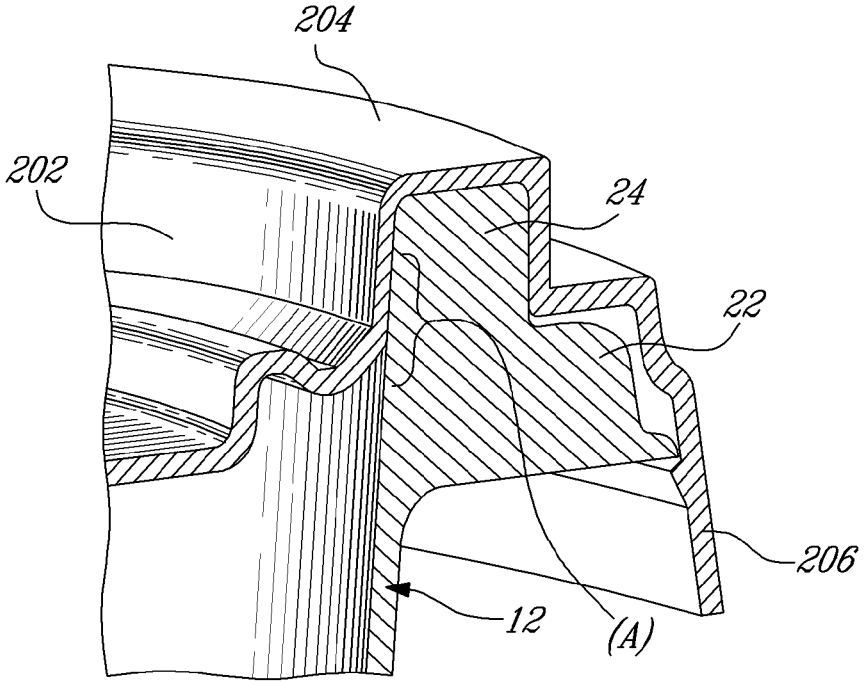
FIGS. 11*a*-11*b* show details of main body and lid of a container according to an embodiment of the present invention.
Figure 11B:
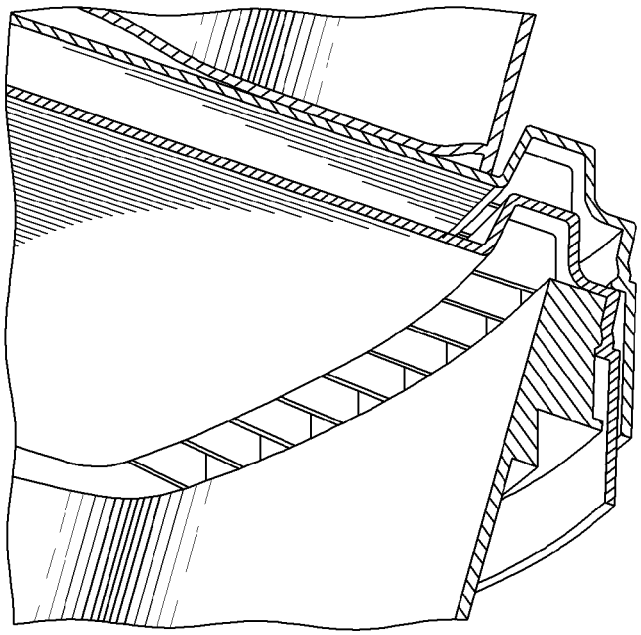

As shown in FIG. 11*a*, the body 202 of the lid 14 may be lower than the rim 204 thereof, thereby providing a sealing surface (A) with the upper walls of the body 12. Alternatively, the lid 14 may be a flat lid 14 as shown in FIG. 11*b*, thereby allowing positioning a film seal for example.

Figure 12A:
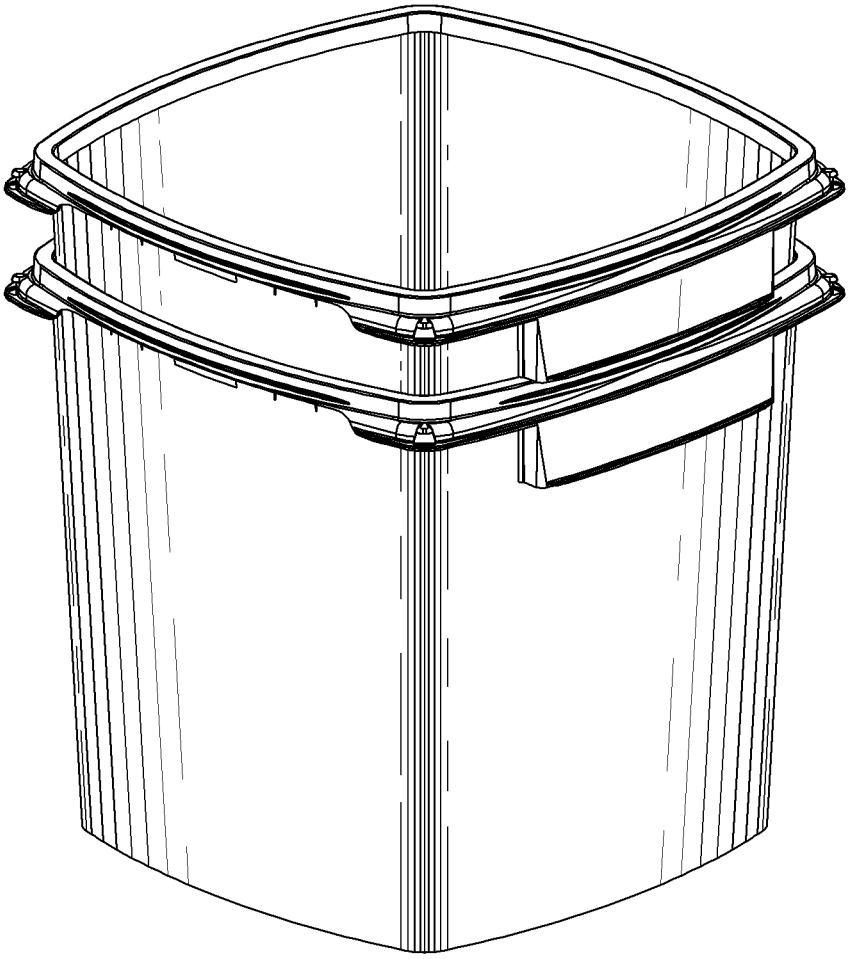
FIGS. 12*a*-12*b* show stacking properties of containers according to an embodiment of the present invention.
Figure 12B:
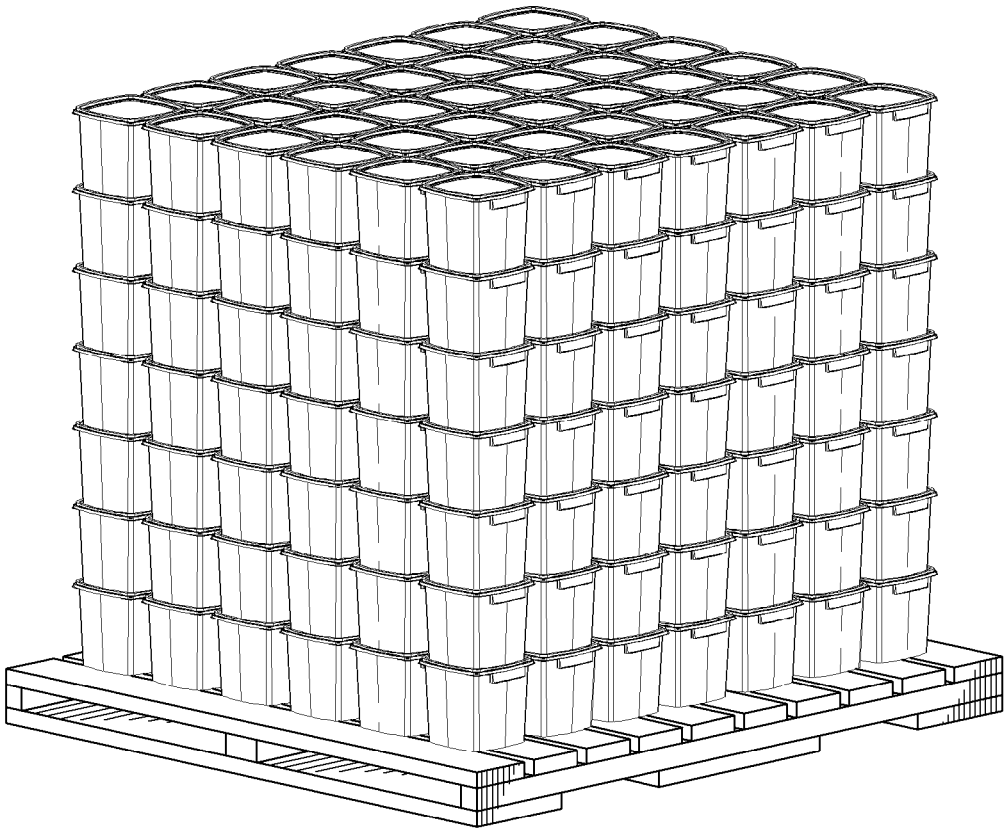

The tampering combination of the present invention does not prevent containers to be stacked together within a minimum volume, as shown in FIGS. 12*a* and 12*b*.

As people in the art will now be in a position to appreciate, the present invention provides an integrity indicator, increasing manufacturers and consumers confidence in product safety. Moreover, the shape of the present containers allows for optimized shipping and warehousing, while providing an intuitive single motion opening.

To close the lid on the main body the first time, the lid is aligned, then pressed and snapped all around while releasing air by pressing the center of the lid to burp container. A container closing roller or mobile plate device can be used. If using an automated closing device, a proper lid air removing system may be used as known in the art. Once the lid is properly positioned on top of the container, it may be opened by grasping the side of the lid where there is no handle and pull using the fingers.

Although the present invention has been described hereinabove by way of specific embodiments thereof, it can be modified, without departing from the nature and teachings of the subject invention as claimed in the appended claims.

The invention claimed is:

1. A container, comprising:

a lid, said lid comprising a central portion, a circumferential rim and a flange extending downwards from said rim, said flange comprising an aperture at least at one location around a perimeter of said flange; and a body, said body comprising a base and generally vertical walls extending up from said base, at least one of the generally vertical walls comprising a knob at least at one location thereof;

wherein, in a closed position of the lid over said body, said knob is received in said aperture and is seen emerging from said aperture, and, upon lifting the lid up from said closed position for the first time, said knob disengages from said aperture, thereby deforming at least one of said aperture and the flange of the lid, said deformed part testifying of a first opening of the container.

2. The container of claim 1, wherein said body is parallelepiped in shape, or round or any combinations thereof, and said lid has a corresponding shape.

3. The container of claim 1, wherein said walls of said body end up in a rim, and, in said closed position, said rim of said lid sits on the rim of the body.

4. The container of claim 1, wherein a portion of said rim of the lid is of a reduced thickness underneath said aperture, and said knob, when disengaging from said aperture, forces on said portion of said rim of the lid, thereby damaging said portion of the rim of the lid.

5. The container of claim 1, wherein said rim of the lid underneath said aperture comprises a weakening line, and said knob, when disengaging from said aperture, forces on said weakening line.

6. The container of claim 1, wherein said rim of the lid underneath said aperture comprises plies, and said knob, when disengaging from said aperture, unfolds said plies.

7. The container of claim 1, wherein said rim of the lid underneath said aperture comprises a radius of curvature, and said knob, when disengaging from said aperture, deforms said radius of curvature.

8. The container of claim 1, wherein said rim of the lid underneath said aperture comprises a geometric shape, and said knob, when disengaging from said aperture, deforms said geometric shape.

9. The container of claim 1, wherein said rim of the lid comprises at least one weakening line about said aperture, and said knob, when disengaging from said aperture, stretches the material of the rim the lid about the aperture or tears off said at least one weakening line or a combination thereof.

10. The container of claim 1, wherein said rim of the lid comprises a break tab, said aperture being located on said break tab.

11. The container of claim 1, wherein said wall comprises a number of knobs and said rim of the lid comprises at least the same number of apertures, at locations around the perimeter of said rim of the lid.

12. The container of claim 1, wherein said deformed part remains attached to said lid.

13. The container of claim 1, wherein said lid is able to be put back again into position over said body, in a closed position of the container.

14. A method of evidencing opening of a container having a body and a lid, comprising:

providing a lid comprising a central portion and a flange extending generally downwards from the central portion, and providing the flange at least at one location thereof, with an aperture;

providing a body of a shape corresponding to the lid, and comprising a base and lateral walls extending up from the base and ending up in a rim, and providing a knob at least at one location of the lateral walls; and positioning the lid over the body so that the knob is received in the aperture and the knob is seen emerging from the aperture, in a closed never opened position of the container;

whereby, upon lifting the lid up from the closed position, the knob disengages from the aperture, thereby deforming at least one of the aperture and the rim of the lid.

15. A container, comprising:

a lid, said lid comprising a central portion, a circumferential rim, said rim comprising an aperture at least at one location around a perimeter of said rim; and a body, said body comprising a base and lateral walls extending up from said base and ending up in a rim, said rim comprising a knob at least at one location thereof;

wherein, in a closed position of the lid over said body, said knob is received in said aperture and is seen emerging from said aperture, and, upon lifting the lid up from said closed position for the first time, said knob disengages from said aperture, thereby deforming at least one of said aperture and the rim of the lid, said deformed part testifying of a first opening of the container; and wherein a portion of said rim of the lid underneath said aperture is of a reduced thickness and/or comprises one of: i) a weakening line; ii) plies, iii) a radius of curvature and iv) a geometric shape; and said knob, when disengaging from said aperture, deforms said portion of said rim of the lid.

* * * * *